US005733212A

United States Patent [19]

Wise et al.

[11] Patent Number: 5,733,212

[45] Date of Patent: Mar. 31, 1998

[54] ELECTRONIC RACKET STRINGING MACHINE

[75] Inventors: Herbert H. Wise, Los Angeles; James A. Calia, Oxnard, both of Calif.

[73] Assignee: Wise U. S. A., Inc., Los Angeles, Calif.

[21] Appl. No.: 727,113

[22] Filed: Oct. 8, 1996

[51] Int. Cl.[6] ..... A63B 51/14

[52] U.S. Cl. ..... 473/557

[58] Field of Search ..... 473/553, 555, 473/556, 557

[56] References Cited

U.S. PATENT DOCUMENTS

| | | | |
|---|---|---|---|
| 1,969,826 | 8/1934 | Tauber et al. . | |
| 2,067,512 | 1/1937 | Sterns . | |
| 2,114,216 | 4/1938 | Doll . | |
| 2,154,870 | 4/1939 | Serrano . | |
| 2,188,250 | 1/1940 | Serrano . | |
| 3,441,275 | 4/1969 | Held . | |
| 3,635,080 | 1/1972 | Krueger et al. . | |
| 3,918,713 | 11/1975 | Kaminstein . | |
| 3,964,291 | 6/1976 | Ogden . | |
| 4,125,259 | 11/1978 | Halbrook | 473/557 |
| 4,348,024 | 9/1982 | Balaban . | |
| 4,366,958 | 1/1983 | Bosworth . | |
| 4,376,535 | 3/1983 | Muselet et al. . | |
| 4,417,729 | 11/1983 | Morrone . | |
| 4,546,977 | 10/1985 | Bosworth, Jr. et al. . | |
| 4,590,808 | 5/1986 | Lightfoot et al. . | |
| 4,593,905 | 6/1986 | Abel | 473/556 |
| 4,620,705 | 11/1986 | Tsuchida . | |
| 4,706,955 | 11/1987 | Ngadi et al. | 473/556 |
| 4,864,875 | 9/1989 | Wise . | |
| 4,878,170 | 10/1989 | Zech . | |
| 5,026,055 | 6/1991 | Longeat . | |
| 5,080,360 | 1/1992 | Longeat . | |
| 5,090,697 | 2/1992 | Lee . | |
| 5,186,505 | 2/1993 | Chu . | |
| 5,269,515 | 12/1993 | Chu . | |

*Primary Examiner*—William E. Stoll

*Attorney, Agent, or Firm*—Mitchell, Silberberg & Knupp LLP

[57] ABSTRACT

A racket stringing machine consists of a racket cradle assembly, to lock a racket frame in place, and a tension head assembly to grip and apply tension to the string during the stringing or restringing process. During the process an electronically controlled, motor-driven assembly holds the loose end of the string and applies tension as it guides it in its motion away from the racket frame. Electronics compare at each instant the tension on the string to a previously dialed-in one and when both are equal the carriage halts.

18 Claims, 16 Drawing Sheets

ELECTRONIC RACKET STRINGING MACHINE

BACKGROUND OF THE INVENTION

1. Field of Invention

The present invention relates to tennis racket stringing machines.

2. The Prior Art

Many machines have been devised for stringing and restringing game rackets, such as those used for tennis, badminton, squash and the like.

After 1969, a process that had previously been done by guess, intuition or the displacement of fixed weights (Serrano, U.S. Pat. No. 2,188,250) became more efficient and precise by using the compression of a spring with its inherent linearity (Held, U.S. Pat. No. 3,441,275) as a comparator. Here the stringing machine FIG. 15 holds the racket in a cradle in a position parallel to the ground 130. The person stringing a racket threads the string through a hole in the racket frame, attaching one end to the racket and the other to an external self-tightening vise 131(snatch vise). The vise is part of a hand cranked tensioning assembly 132 (tension head) that automatically brakes when the tension on the string equals the tension preset on a helical bias spring. The tension head runs on a track 133 that draws the string away from the racket while tensioning. This is the so-called Pull and Brake method.

Modified, Held's device is still used universally although its accuracy is often called into question, its resolution is limited and it needs frequent calibration. In substantially similar forms this machine is manufactured by Ektelon, Gamma, Alpha, Czech Sports, Eagnas, Toalson, Gossen, Kennex, Winn and others.

From 1975, machines surfaced that used electric motors to replace the hand crank that compresses the bias spring (Kaminstein, U.S. Pat. No. 3,918,713), (Tsuchida, U.S. Pat. No. 4,620,705) and (Muselet et al., U.S. Pat. No. 4,376,535).

Some machines used hydraulics or pneumatic systems as the power source (Morrone, U.S. Pat. No. 4,417,729).

When wooden rackets became obsolete, rackets of aluminum, graphite, boron, ceramic, Kevlar, etc. made their appearance along with hundreds of kinds of new strings made of different plastics and multi-layered filaments. Improvements to the equipment required an improvement in the accuracy of the tools needed for their stringing and thus electronic machines.

Babolat of France (U.S. Pat. No. 5,026,055) and Poreex of Taiwan (U.S. Pat. No. 5,090,697) manufacture essentially duplicate electronic machines sold under their own name and brand labeled for others. In their device the snatch vise is driven by a spring-loaded chain drive.

Not unlike earlier machines the chain drive compresses a helical spring. Running parallel to this bias spring is a linear potentiometer. The electronics read the linear potentiometer as it measures the spring compression and indirectly the tension on the string through the intermediary of the chain/spring/potentiometer assembly.

All electronic machines are "Constant Pull" machines and continue to apply tension even after the dialed-in tension is reached because strings lose some tension seconds after their initial pull. This Constant Pull feature is often the cause of undesirable results. Knowledgeable players ask their stringer which machine will be used to string their racket, mechanical (Pull and Brake) or electronic (Constant Pull). The results can be substantially different. Electronic machines will invariably produce a racket that is 5–10 percent tighter (where it appears as if more tension has been applied to the strings) than a Pull and Brake machine. Professional players claim they can feel the difference in small fractions of a pound.

SUMMARY OF THE INVENTION

As can be seen, both mechanical and electronic machines read the applied tension to the racket string indirectly, that is, as a relationship to a bias spring. It is the objective of this device to read the tension applied to the racket string directly and consequently more accurately.

It is further the objective to use this tensioning device to replace the mechanical tension heads currently used on mechanical machines.

It is further the objective to simplify any such device, to make it transportable, to make it more durable, less complicated and easier to repair if need be.

Also, the objective is to display digitally, the input value of the tensioning device and to report with error codes any irregularities the electronics may uncover.

DESCRIPTION OF THE PREFERRED EMBODIMENTS

Figure 1:
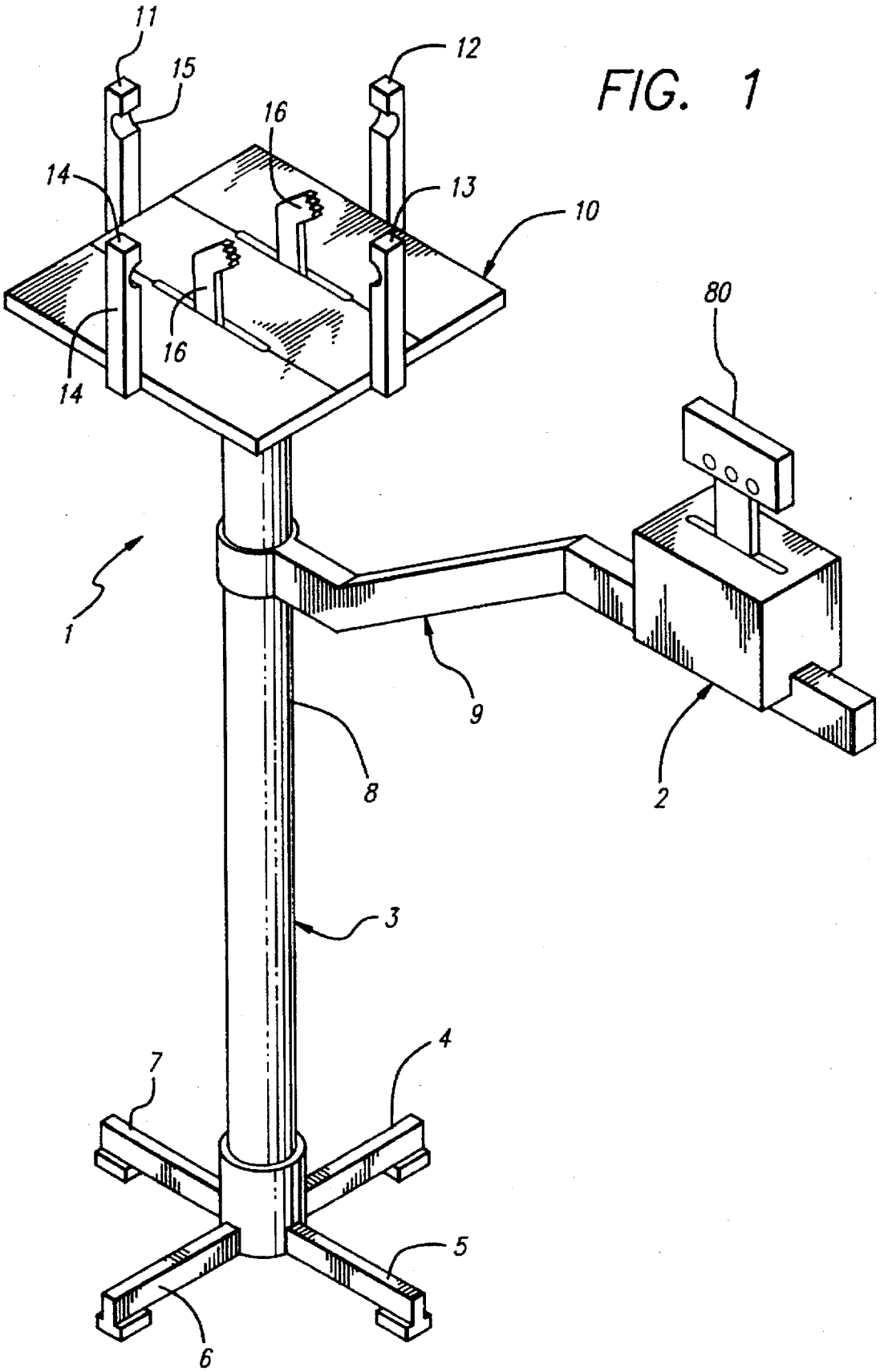
FIG. 1 is a view in perspective of the applicant's stringing machine.

FIG. 1 is a view of applicant's stringing machine with its two major components, the racket cradle assembly 1 and the tension head assembly 2. The stringing machine has a base 3 including legs 4, 5, 6 and 7 spaced from each other at 90° degrees. The base also includes a vertical support column 8, on top of which is fitted the racket cradle assembly tension bar 9. Mounted on the support column and above the tension bar is the racket cradle assembly which takes the form of a turntable. Both the tension bar and the racket cradle assembly pivot on the support column so that when a racket is mounted onto the cradle, as we will see, the string can be aligned from the point it leaves the racket frame to where it enters the snatch vice 80.

The racket cradle assembly platen 10 has two functions; to support four movable posts or fixing elements 11, 12, 13 and 14 that are placed at the top, bottom and two sides of the racket and ensure the horizontal clamping in position of the tennis racket to be strung. The elements 11, 12, 13 and 14 are arranged in exactly the same way so it is sufficient to describe only one of them, for example fixing element 11. The fixing element 11 is grooved 15 and fitted with a non-skid surface to grasp the tennis frame firmly.

The elements are arranged and fixed to the racket cradle platen, opposite one another about the longitudinal axis of the racket cradle, which corresponds to the axis of symmetry of the racket. The elements are adjusted to accept any size racket by moving their supporting bracket, and when pressed against the outer wall of the racket frame support the frame from distortion during the stringing process. Once the four fixing elements support the racket the elements are firmly locked into place. The racket cradle assembly platen also supports two string clamps 16. These clamps move freely on the racket cradle platen through slots in the platen but once they are appropriately positioned to hold the string a single motion of the lever arm 17 locks the string in the clamp and firmly seats the clamp onto the platen. One of the clamps holds the racket end of the string while the loose end of the string is being tensioned by the tension head assembly. Once the string is tensioned the second clamp holds the string under tension. The process is repeated after the racket is rotated 180° degrees and the loose end of the string is woven anew into the next hole in the racket frame.

The particular design of the racket cradle is not important to the present invention and the racket cradles in the following United States patents can be used as part of the present invention: (1) U.S. Pat. No. 5,090,697 on Racket Frame Stringing Machine issued to Lee on Feb. 25, 1992; (2) U.S. Pat. No. 5,080,360 on Equipment For Stringing A Tennis Racket issued to Longeat on Jan. 14, 1992; (3) U.S. Pat. No. 5,186,505 on Chucking Device Of Racket Stringing Machine issued to Chu on Feb. 16, 1993; (4) U.S. Pat. No. 5,026,055 on Equipment For Stringing A Tennis Racket issued to Longeat on Jun. 25, 1991; (5) U.S. Pat. No. 4,874,170 on String Clamp For Racquet Stringing Machine issued to Zech on Oct. 17, 1989; (6) U.S. Pat. No. 4,620,705 on Racket Stringing Device issued to Tsuchida on Nov. 4, 1986; (7) U.S. Pat. No. 4,417,729 on Racket Stringing Apparatus issued to Morrone on Nov. 29, 1983; (8) U.S. Pat. No. 4,546,977 on Racquet Stringing Machine With Improved Racquet Retaining Standard issued to Bosworth, Jr. et al., on Oct. 15, 1985; (9) U.S. Pat. No. 4,376,535 on Machine For Stringing Rackets issued to Muselet et al., on Mar. 15, 1983; (10) U.S. Pat. No. 4,366,958 on Racket Stringing Machines issued to Bosworth on Jan. 4, 1983; (11) U.S. Pat. No. 4,348,024 on Racket Stringing Apparatus And Method issued to Balaban on Sep. 7, 1982; (12) U.S. Pat. No. 3,918,713 on Racket Stringing Machine issued to Kaminstein on Nov. 11, 1975; and (13) U.S. Pat. No. 3,441,275 on Racket Stringer issued to Held on Apr. 29, 1969. The specifications and drawings of each of these 13 listed United States Patents are hereby incorporated herein as though set forth in full.

Figure 2:
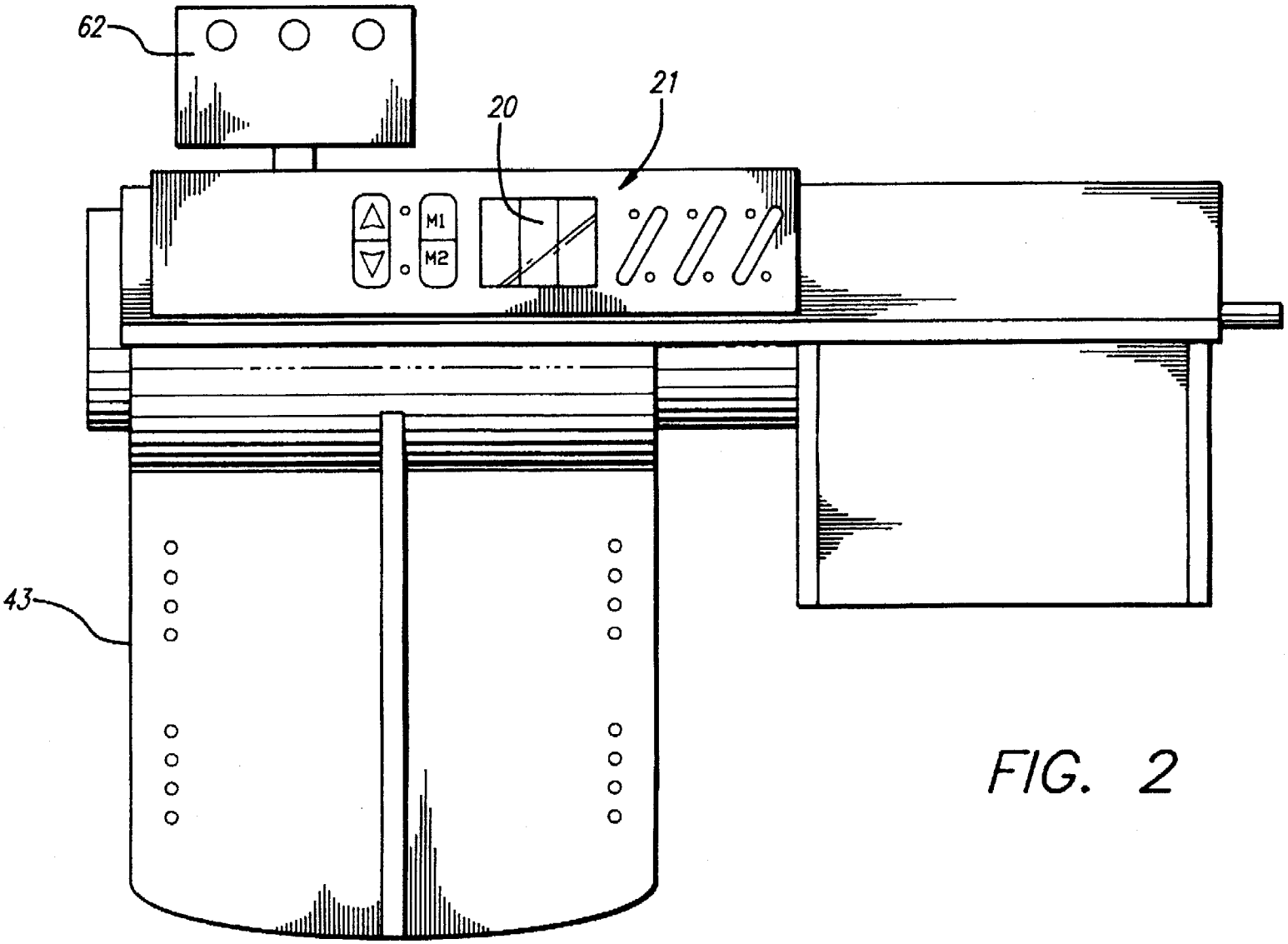
FIG. 2 is a view in perspective of the tension head enclosure and keypad.
Figure 7:
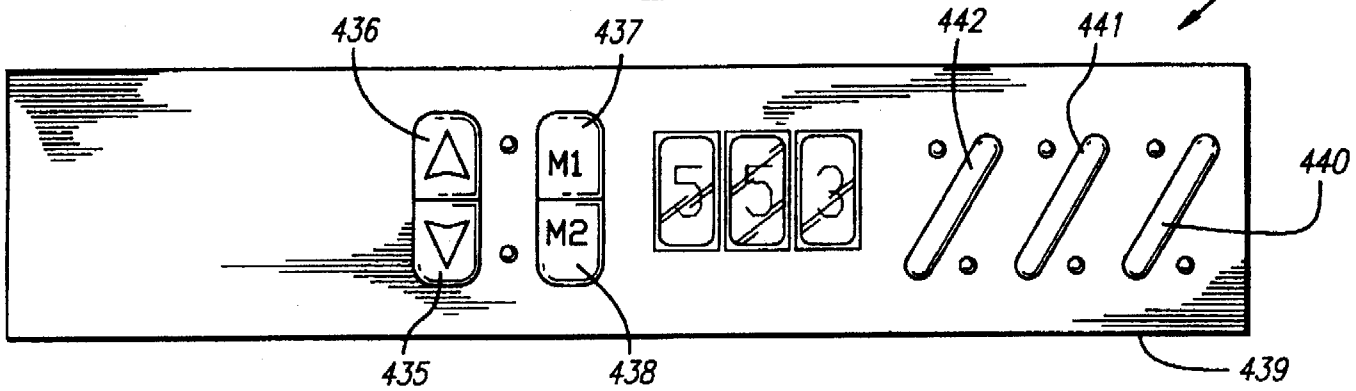
FIG. 7 is a view of the keypad.

FIG. 2 is a perspective view of the tension head enclosure showing the display window 20 the keypad area 21, the enclosure stand 43 and the brace 62. The keypad is shown in FIG. 7.

Figure 3:
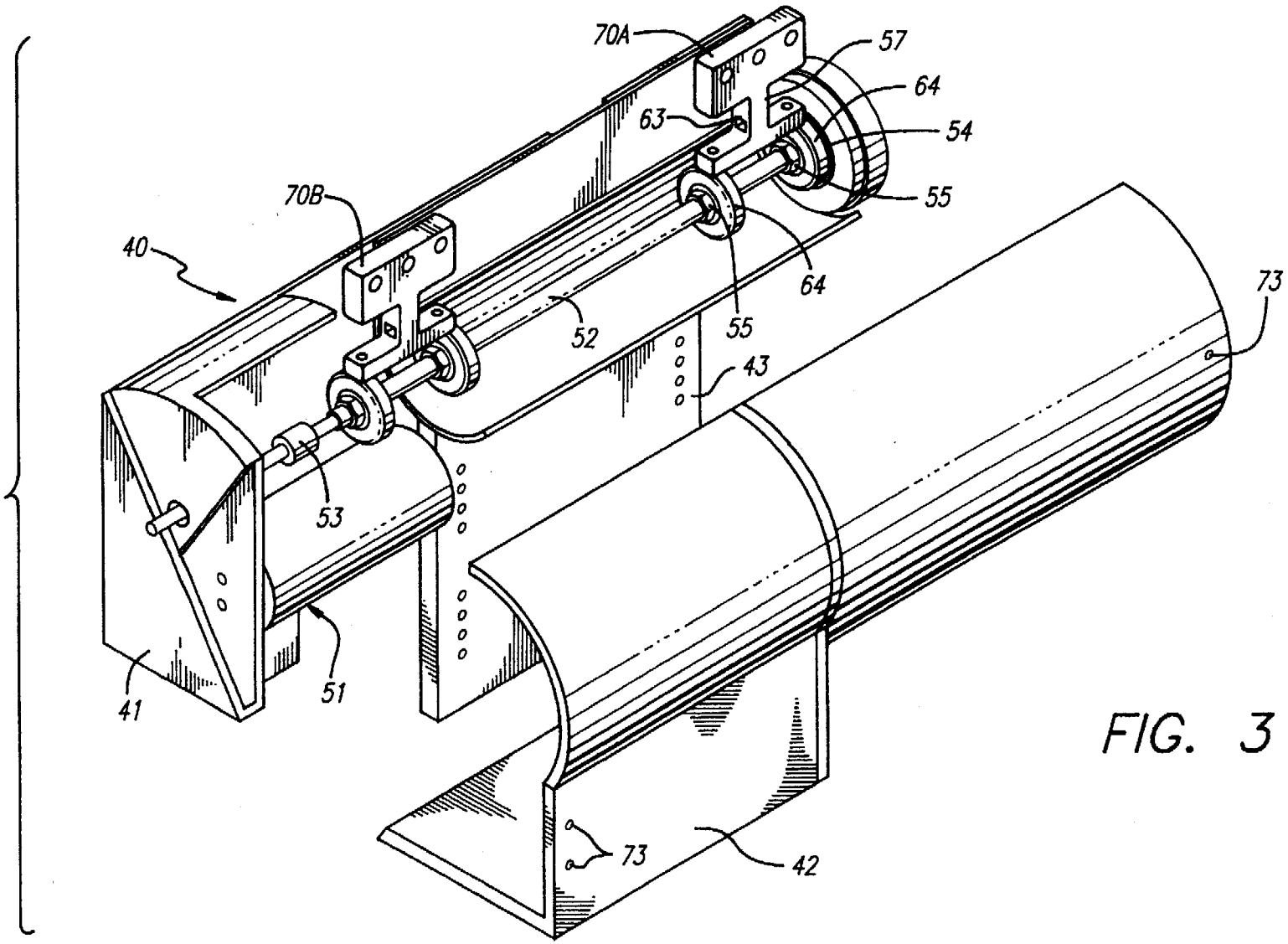
FIG. 3 is a view in perspective of the tension head assembly, opened.

FIG. 3 is a perspective view of the tension head assembly. The tension head assembly 40 consists of four assemblies; the motor drive screw assembly with gear motor 51, lead screw 52 (other types of ball screws can be used), coupler 53 and bearing 54 and the screw nuts 55; the snatch vise cradle assembly with the snatch vise 61(not shown here), brace 62 with the attached strain gauges 63, the left and right flanges 64, and the left and right nuts 55; the electronic controller assembly; and the tension head enclosure 41 and back cover assembly 42. Four screws 73 secure the tension head enclosure back cover to the tension head enclosure. In FIG. 3 the snatch vise assembly is shown twice, in its forward 70A and its retracted positions 70B. The tension head assembly stand 43 is mounted with four bolts onto the racket cradle assembly tension bar 9 and allows for height alignment of the tension head with various types of racket cradle assemblies.

The gear motor (preferably a DC motor) and its drive shaft are mounted longitudinally, with the motor gearbox secured to the tension head enclosure inner wall. The coupler is located on the end of the motor drive shaft.

The lead screw 52 is connected to the motor drive shaft via the coupler 53. The coupler has two set screws to secure the end of the lead screw to the end of the motor drive shaft. The opposite end of the lead screw is slid into the bearing 54. Said bearing is located in a recess within the enclosure wall 57 closest to the racket cradle assembly.

Figure 4:
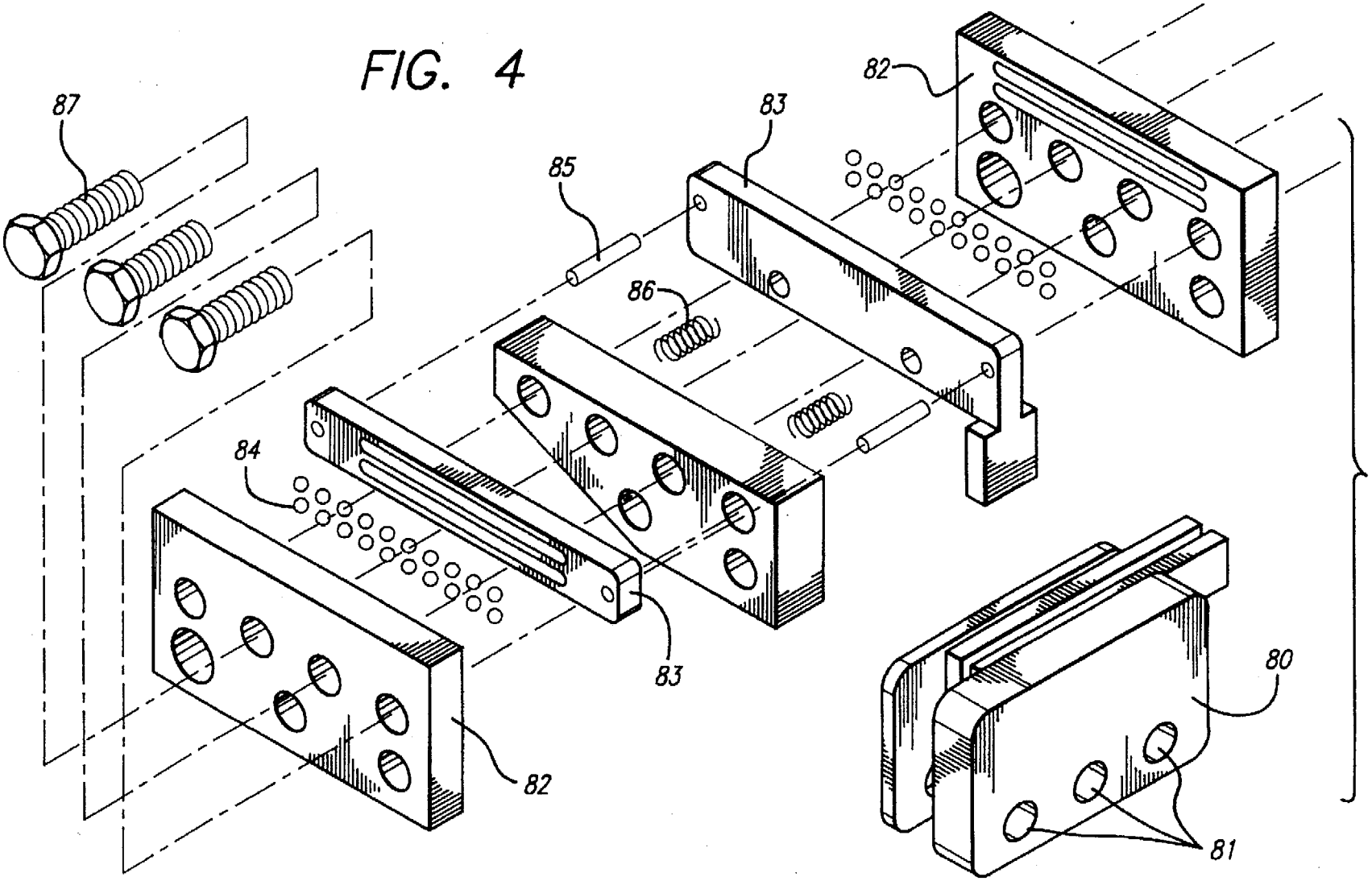
FIG. 4 is a view in perspective of the snatch vice.

FIG. 4 shows the snatch vice 80. The lower half of the snatch vise contains an opening which is slightly wider than the thickness of the brace. The top of the brace FIG. 5, 91 fits within said opening where the three holes 81 in the top of the brace align with the three holes in the lower half of the snatch vise and is secured to the top of the brace by three bolts 87. Onto the brace are mounted the compression strain gauge and the tension strain gauge FIG. 5.

Two sets of grooves in each outer wall 82 correspond to similar grooves in the two jaws 83. The two jaws slide within the outer walls on ball bearings 84, are aligned to each other by pins 85 and held apart with small internal springs 86. The depth of the groves in the walls and jaws vary from one end of the groove to the other. At the point where the grooves are deepest the jaws remain farthest apart as the springs force the jaws open allowing the loose end of the string to be inserted between the jaws. The jaws become a self-closing vice as soon as tension is applied to the string because the grooves become shallower at the front end of the snatch vise and the jaws close as they are motor driven away from the racket cradle.

Turning back to FIG. 3, the right flange is aligned, just beneath the brace, on the right side of the brace. The top of the right flange contains a tapped hole (FIG. 5 88) which aligns with a through hole in the right side of the brace. A bolt secures the right flange to the right side of the brace. The left flange is attached to the left side of the brace in a similar manner. Both flanges are secured perpendicular to the brace and parallel to each other. The right nut contains both inner threads and other threads. The outer threads of the right nut match the inner threads of the right flange. The right nut is screwed into the right flange, with the unthreaded portion of the right nut outer thread under the brace. The left nut is secured to the left flange in a similar manner. The inner threads of both the right and left nuts match the thread of the lead screw of the motor drive screw assembly.

The snatch vise carriage assembly is connected to the motor drive screw assembly by screwing the lead screw, of the motor drive screw assembly into both nuts of the snatch vise carriage assembly. The snatch vise carriage assembly is thus allowed to translate the length of the lead screw in both directions by applying a positive or a negative voltage to the gear motor.

The sides of the brace of the snatch vise carriage assembly align with the walls of the tension head enclosure and the tension head enclosure back cover. Said walls prohibit the snatch vise carriage assembly from any rotational motion, while allowing the snatch vise carriage assembly to translate in the direction parallel to the racket cradle assembly tension head bar.

Figure 5:
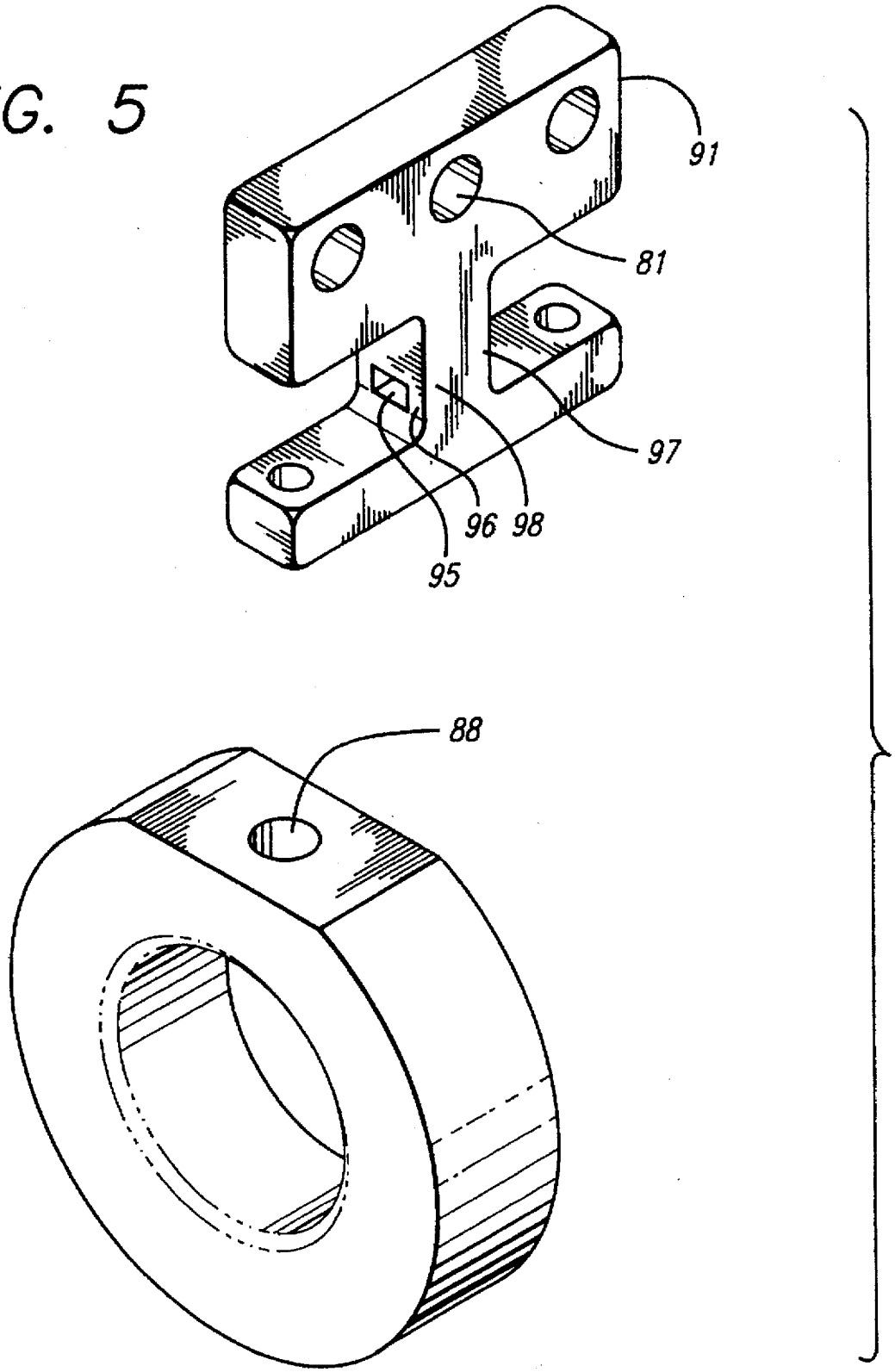
FIG. 5 is a view in perspective of the brace and flange.

As shown in FIG. 5 the compression strain gauge 95 is attached by an adhesive to the vertical wall 96 of the brace parallel and furthest from the motor gear box. The tension strain gauge 97 is attached to the opposite wall 98 of the brace directly behind the compression strain gauge, in a similar manner.

Figure 6:
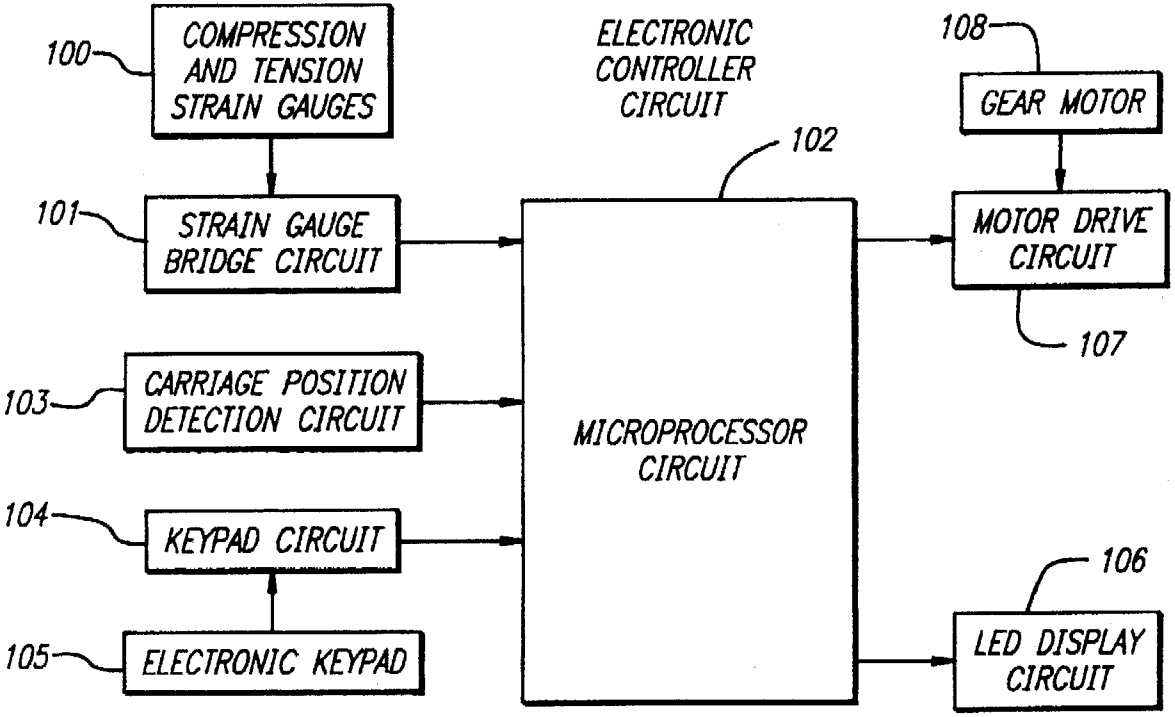
FIG. 6 is a block diagram of the electronic controller assembly.

FIG. 6 is a block diagram showing the control operation of the present invention. Output from the compression and tension strain gauges 100 is input into a strain gauge bridge circuit 101. Output from the strain gauge bridge circuit is input into a microprocessor circuit 102. The microprocessor circuit also receives input from a carriage position detection circuit 103 and a keypad circuit 104, and which receives input from an electronic keypad 105. The microprocessor circuit outputs to an LED display circuit 106 such that the tension reading from the compression and tension strain gauges is displayed and also provides input into motor drive circuit 107 which in turn operatively controls a gear motor 108.

Figures 1, 8:
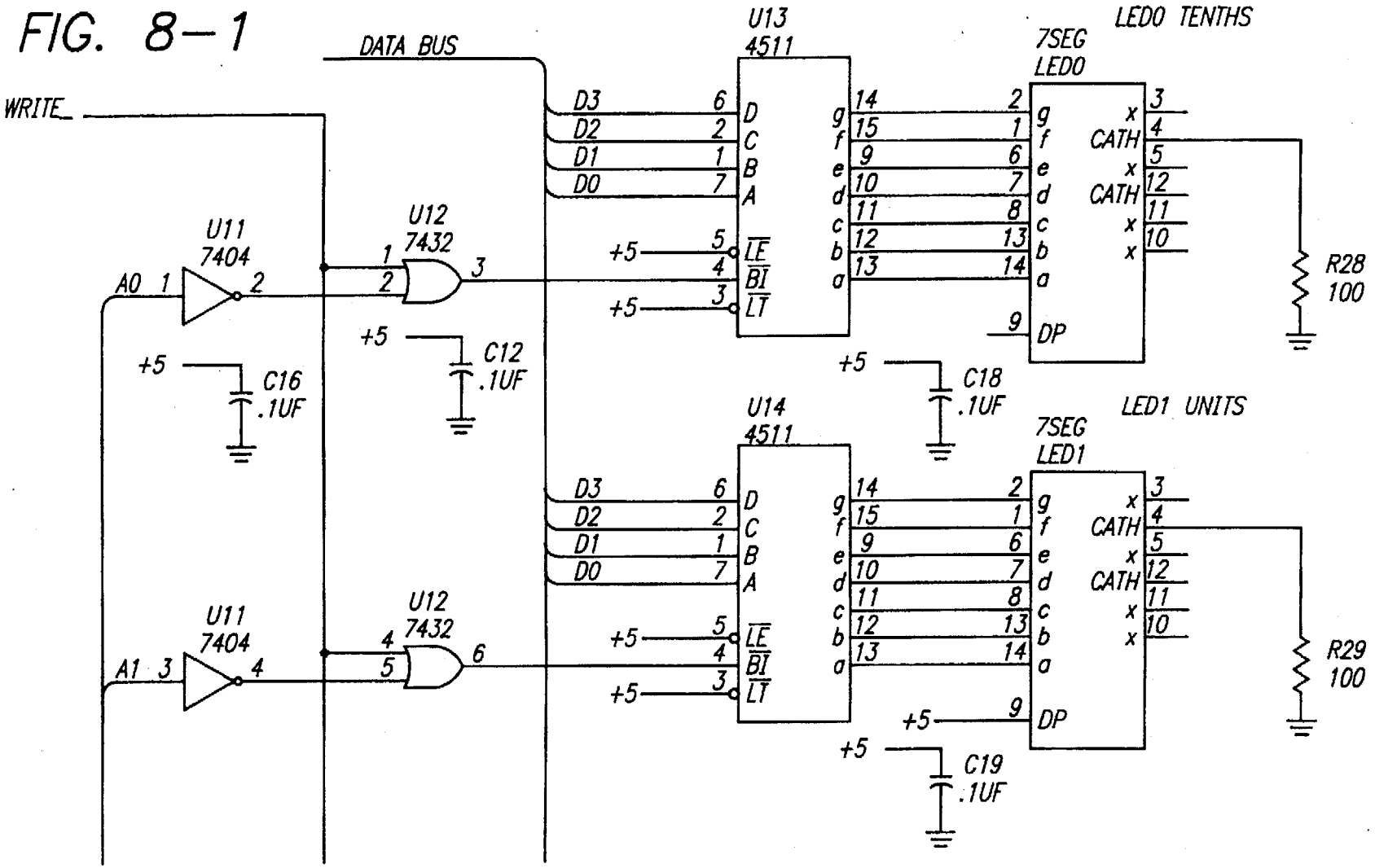
FIG. 8 is the display circuit schematic diagram.
Figures 2, 8:
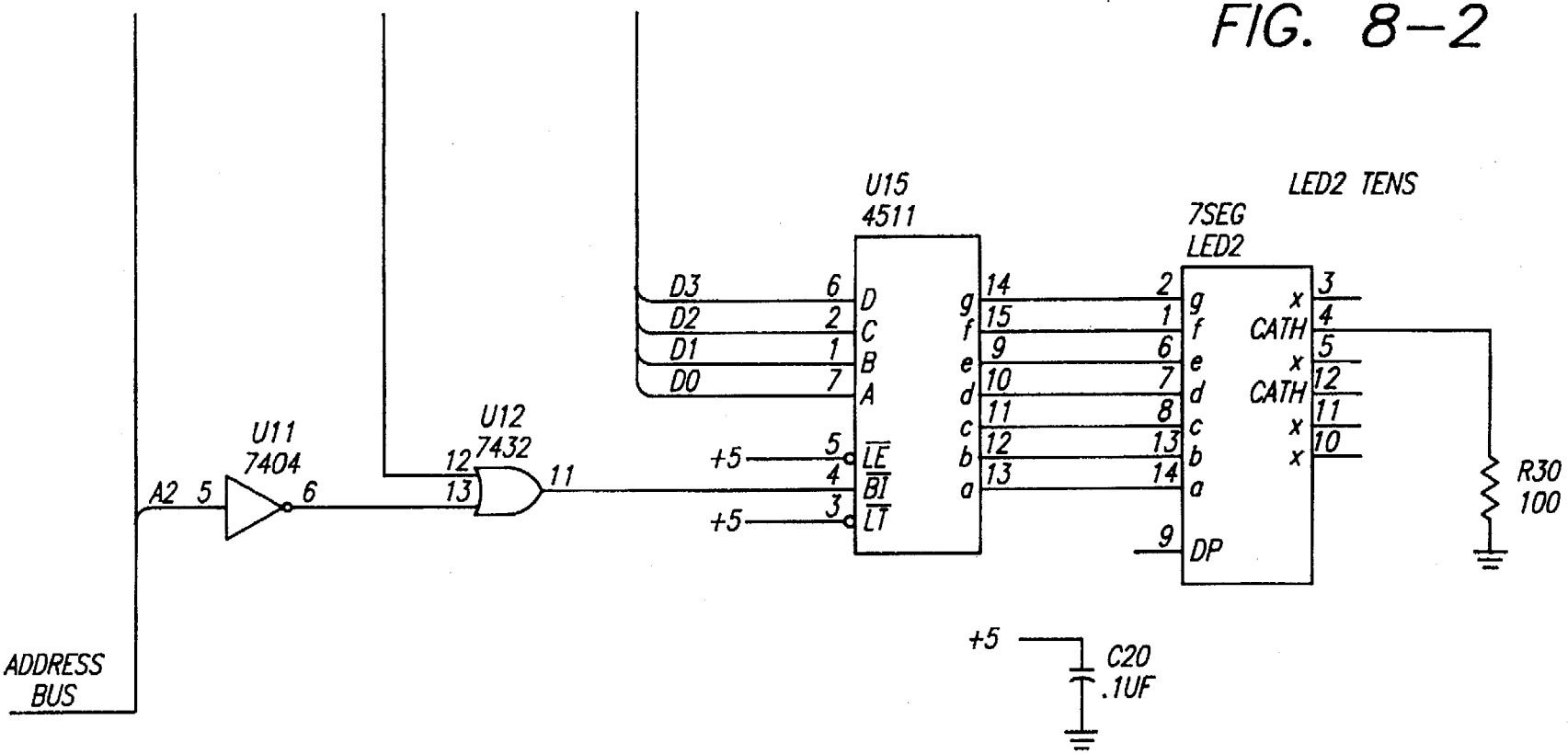
Figure 9:
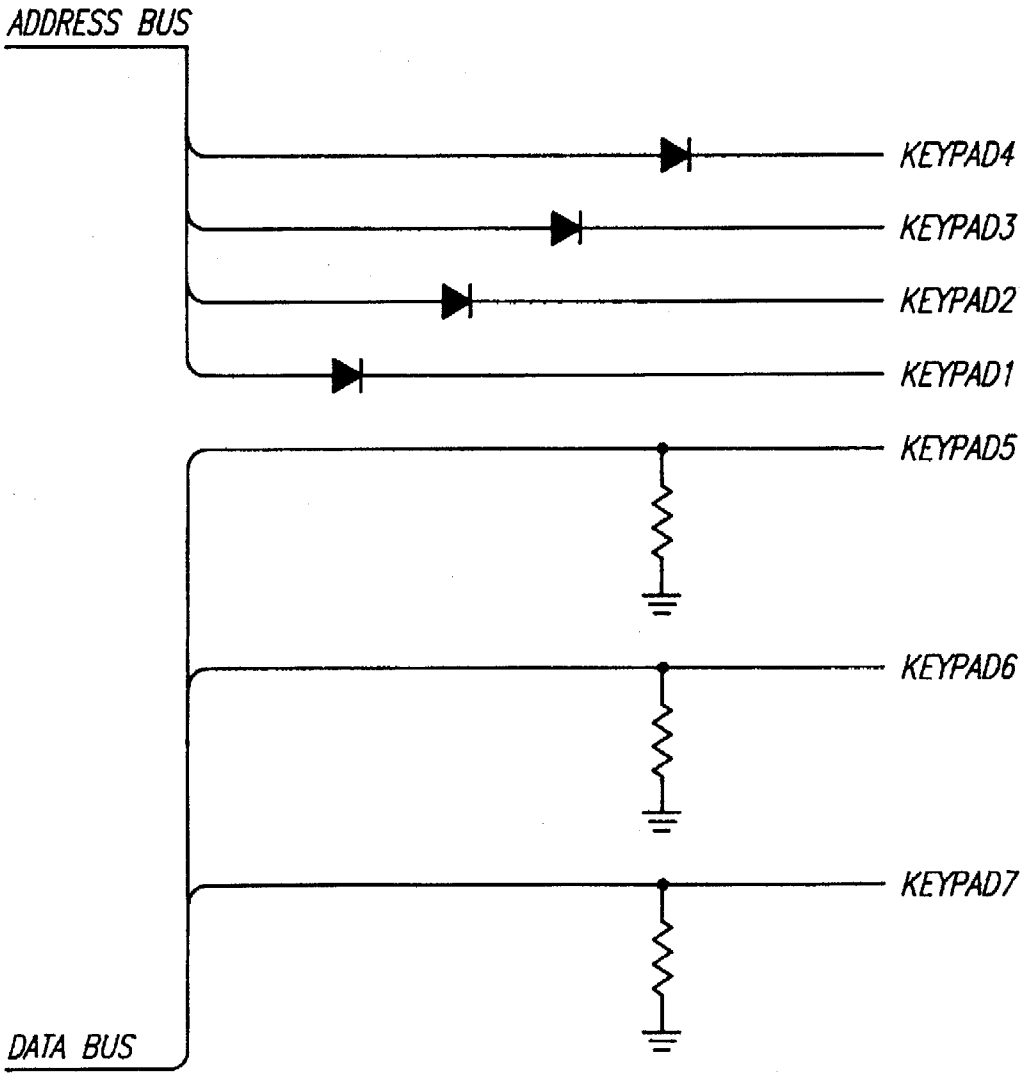
FIG. 9 is the keypad circuit schematic diagram.
Figure 10A:
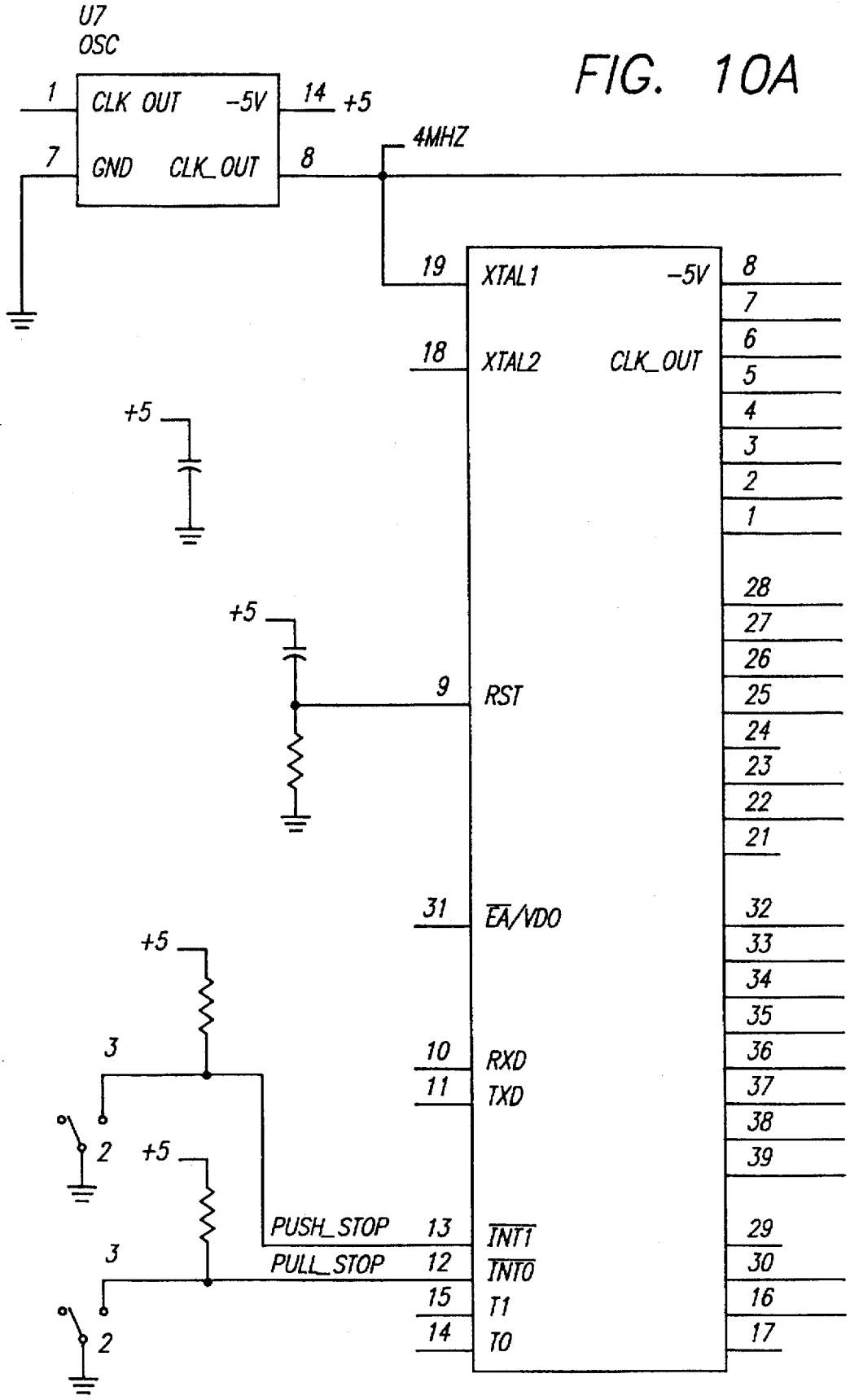
FIG. 10 is the microprocessor circuit schematic diagram.
Figure 10B:
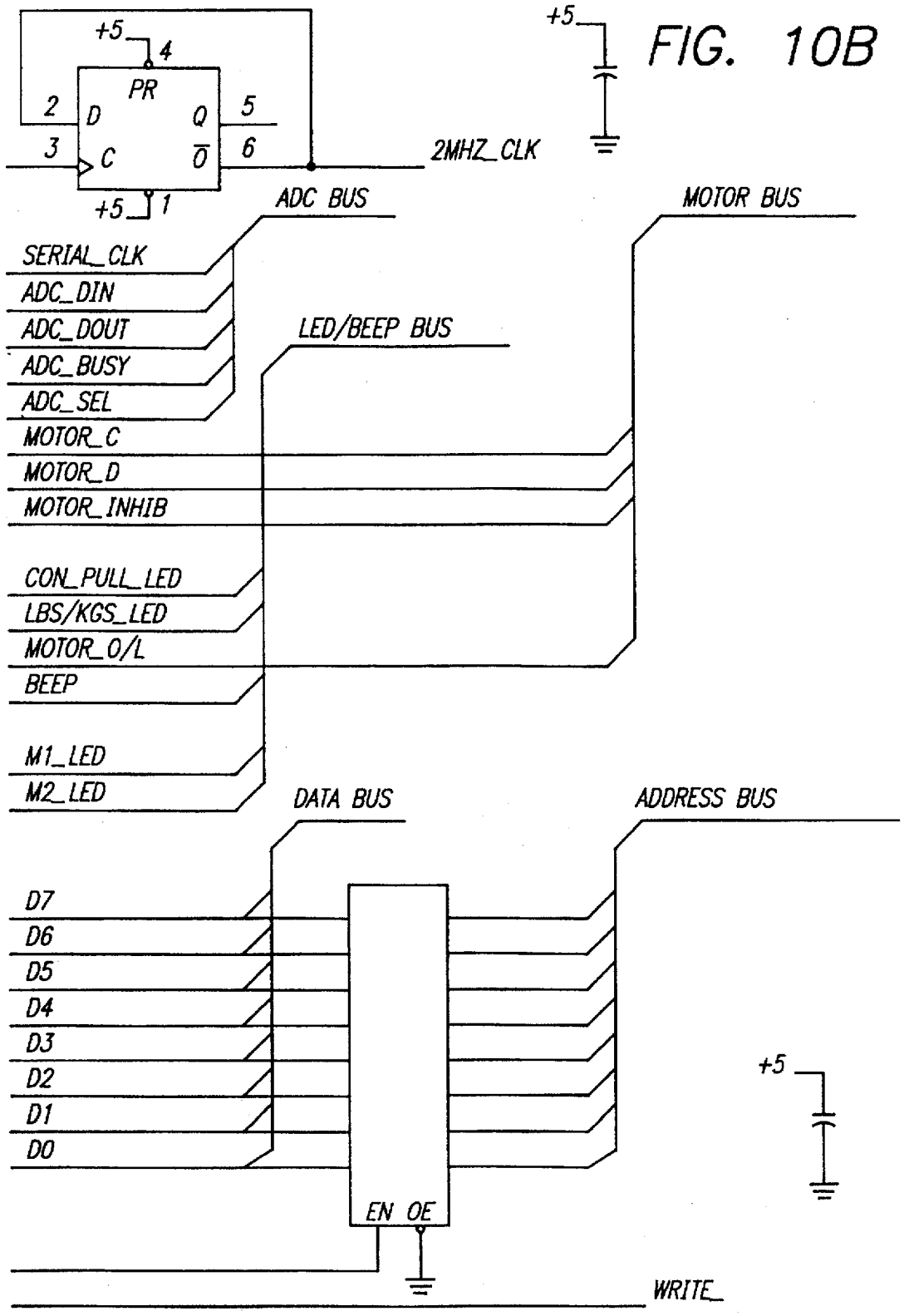
Figure 13:
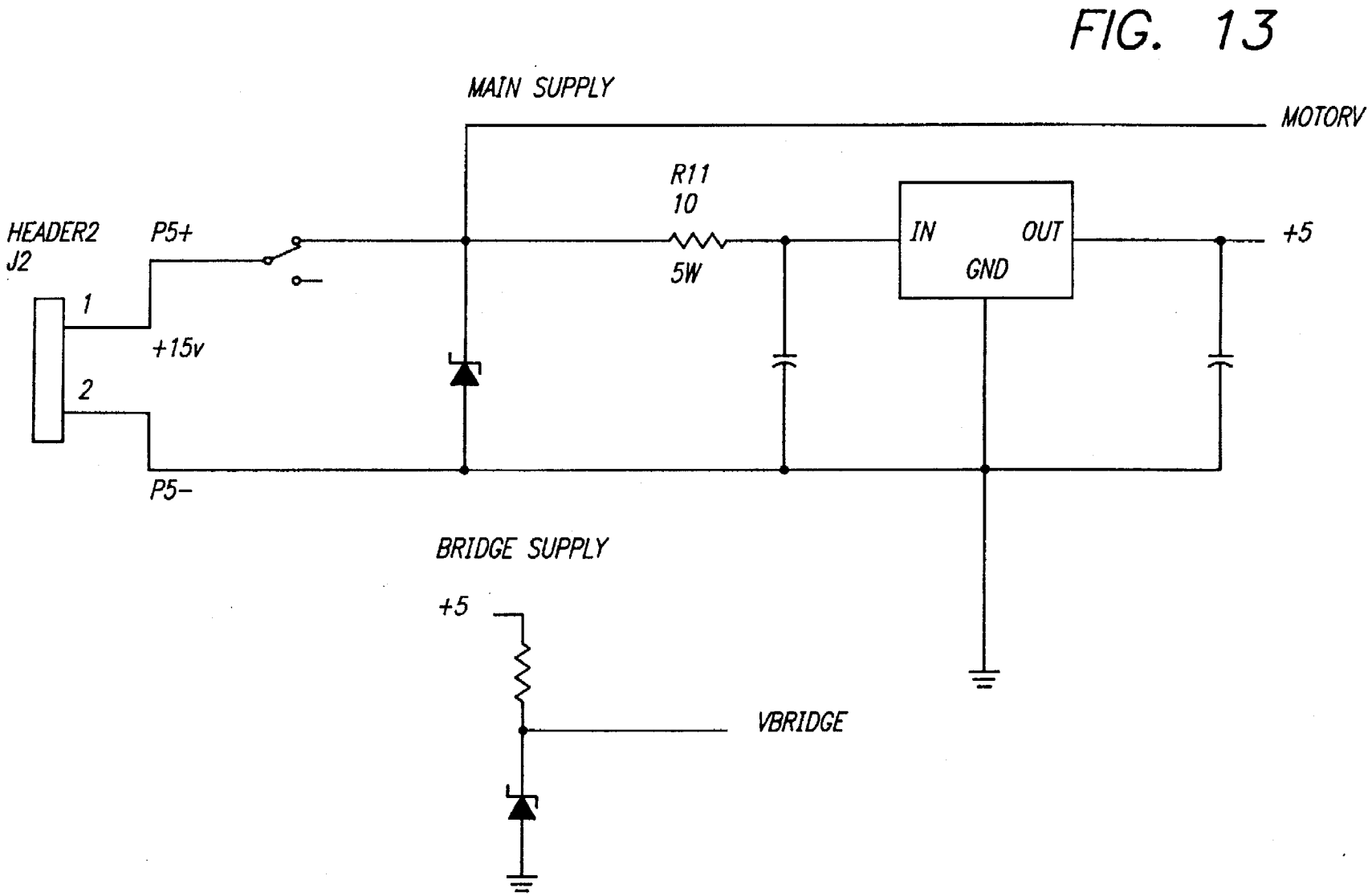
FIG. 13 is the power supply circuit schematic diagram.
Figure 14:
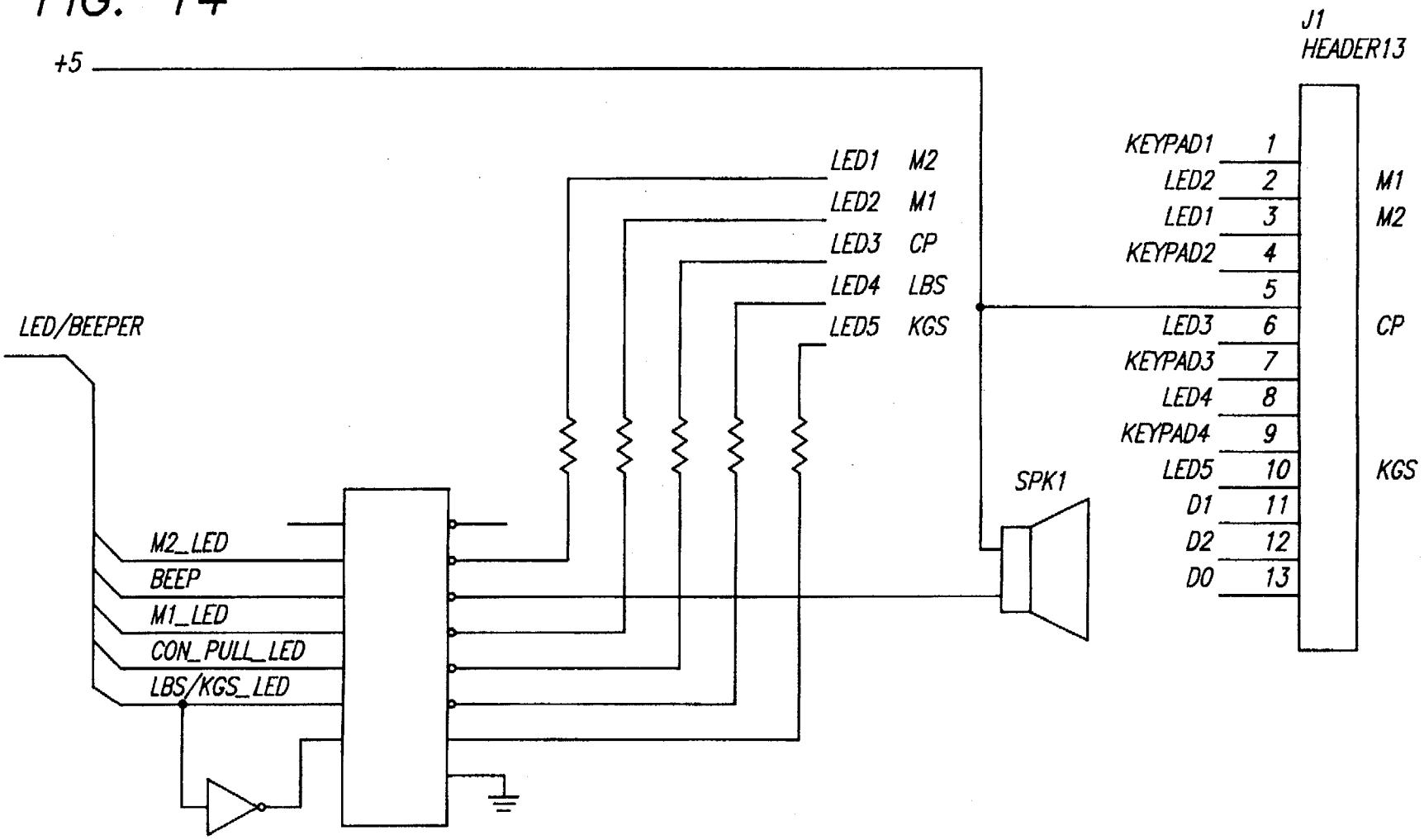
FIG. 14 is the LED/beeper circuit schematic diagrams.
Figure 15:
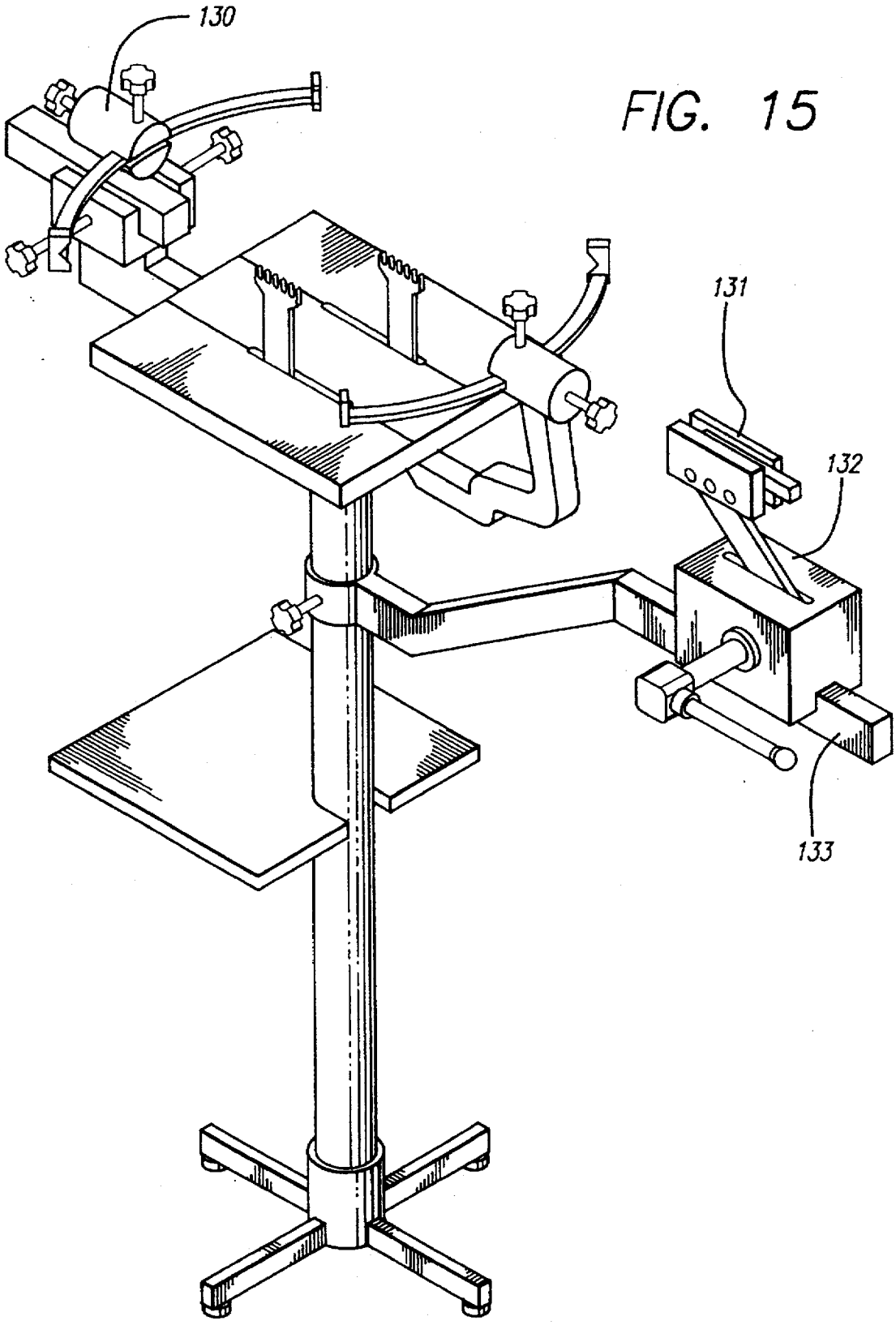
FIG. 15 is a view in perspective of a conventional mechanical stringing machine.

The electronic controller assembly consists of the electronic controller circuit board onto which is mounted the electronic keypad 120 in FIG. 7. The electronic controller circuit board is mounted inside the tension head enclosure, just behind the tension head enclosure display window opening. The electronic controller circuit consists of the following sub circuits; the strain gauge bridge sub circuit, FIG. 12, the keypad sub circuit, FIG. 9, the motor controller sub circuit, FIG. 11, the LED driver sub circuit, FIG. 14, the microprocessor sub circuit, FIG. 10, the power supply sub circuit, FIG. 13 and the display sub circuit, FIG. 8.

Figure 12:
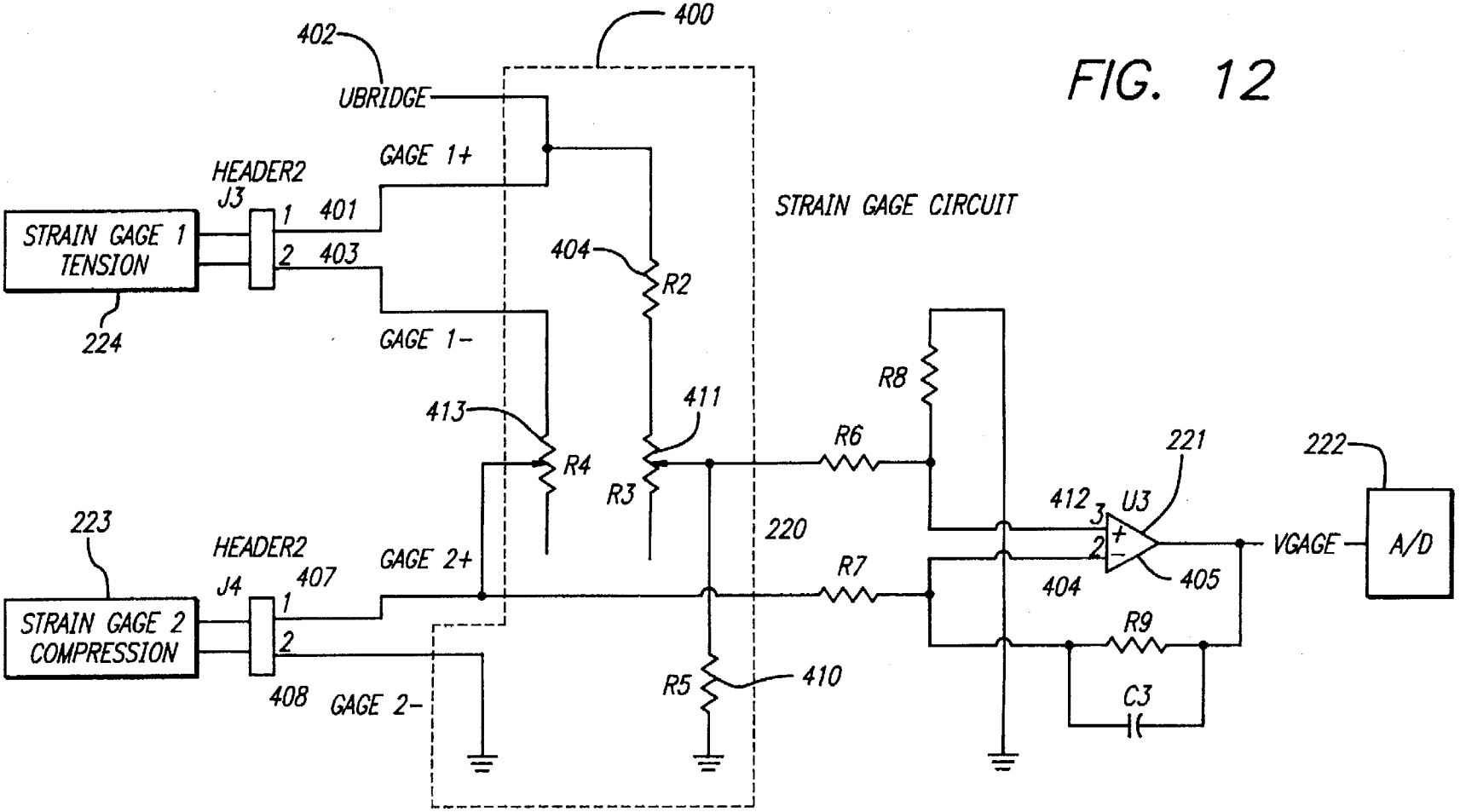
FIG. 12 is the strain gauge circuit schematic diagram.

As shown in FIG. 12, the strain gauge bridge sub circuit consists of the following components; the whetstone bridge, the operational amplifier 221, and the analog to digital converter 222. Both the compression strain gauge 223 and the tension strain gauge 224 are connected to the electronic controller circuit board (preferably by a five conductor shielded cable with twisted pairs such that one of the twisted conductor pairs is connected to the two legs of the compression strain gauge, the other of the twisted conductor pairs is connected to the tension strain gauge and the shield of the said cable is connected to ground on the electronic controller circuit board). One leg of the compression strain gauge is connected to the whetstone bridge reference voltage, while the other leg of the compression strain gauge is connected to both the positive input of the operational amplifier and one leg of the tension strain gauge. The other leg of the tension strain gauge is connected to ground. Thus the two strain gauges make up one side of the whetstone bridge circuit.

Two temperature match resistors are connected accordingly to form the other side of the whetstone bridge circuit. With the node connecting said resistors also connecting to the negative input of the operational amplifier.

The operation of the strain gauge bridge circuit is as follows. When a longitudinal force is exerted on the snatch vise, in a direction towards the racket cradle, a bending moment is experienced by the brace. This bending moment will create a compression strain along the surface of the brace where the compression strain gauge is located. Said bending moment will, at the same time, create a tension strain along the surface of the brace where the tension strain gauge is located. When the compression strain gauge experiences compression strain, the resistance of the compression strain gauge decreases proportionally to the force exerted on the snatch vise. When the tension strain gauge experiences a tension strain, the resistance of the tension strain gauge increases proportionally to the force exerted on the snatch vise. When the resistance of the compression strain gauge decreases while the resistance of the tension strain gauge increases, the voltage at the node connecting the two strain gauges, increases with respect to the voltage at the node connecting the resistors of the bridge together. The difference in the voltage at the two bridge nodes is known as the bridge output voltage 220. The bridge output voltage increases proportionally with the force exerted on the snatch vise. The compression strain gauge and the tension strain gauge are temperature matched, their change in resistance with temperature are the same. The two bridge resistors are also temperature matched. Therefore any resistance change in the strain gauges, due to temperature change, will be exactly the same, thus the voltage at the node where the two strain gauges are connected will not vary with change in temperature. Any resistance change in the two bridge resistors resistances, due to temperature, will also be the same, thus the voltage at the bridge node connecting the two bridge resistors together will not vary with temperature. The bridge output voltage, which is the difference in the two node voltages of the bridge, also will not vary with change in temperature. Therefore the bridge output voltage is temperature independent.

The bridge output voltage 220 is fed into the operational amplifier 221 which amplifies it and feeds it to the analog to digital converter 222. The analog to digital converter converts the operational amplifier's output voltage to a 14 bit digital numerical representation. This 14 bit digital numerical representation is known as the bridge_strain.

The value of the bridge_strain is directly proportional to the force exerted on the snatch vise. The analog to digital converter is connect to the microprocessor circuit via a digital interface over which the bridge_strain value is passed to the microprocessor circuit FIG. 10.

Figure 11:
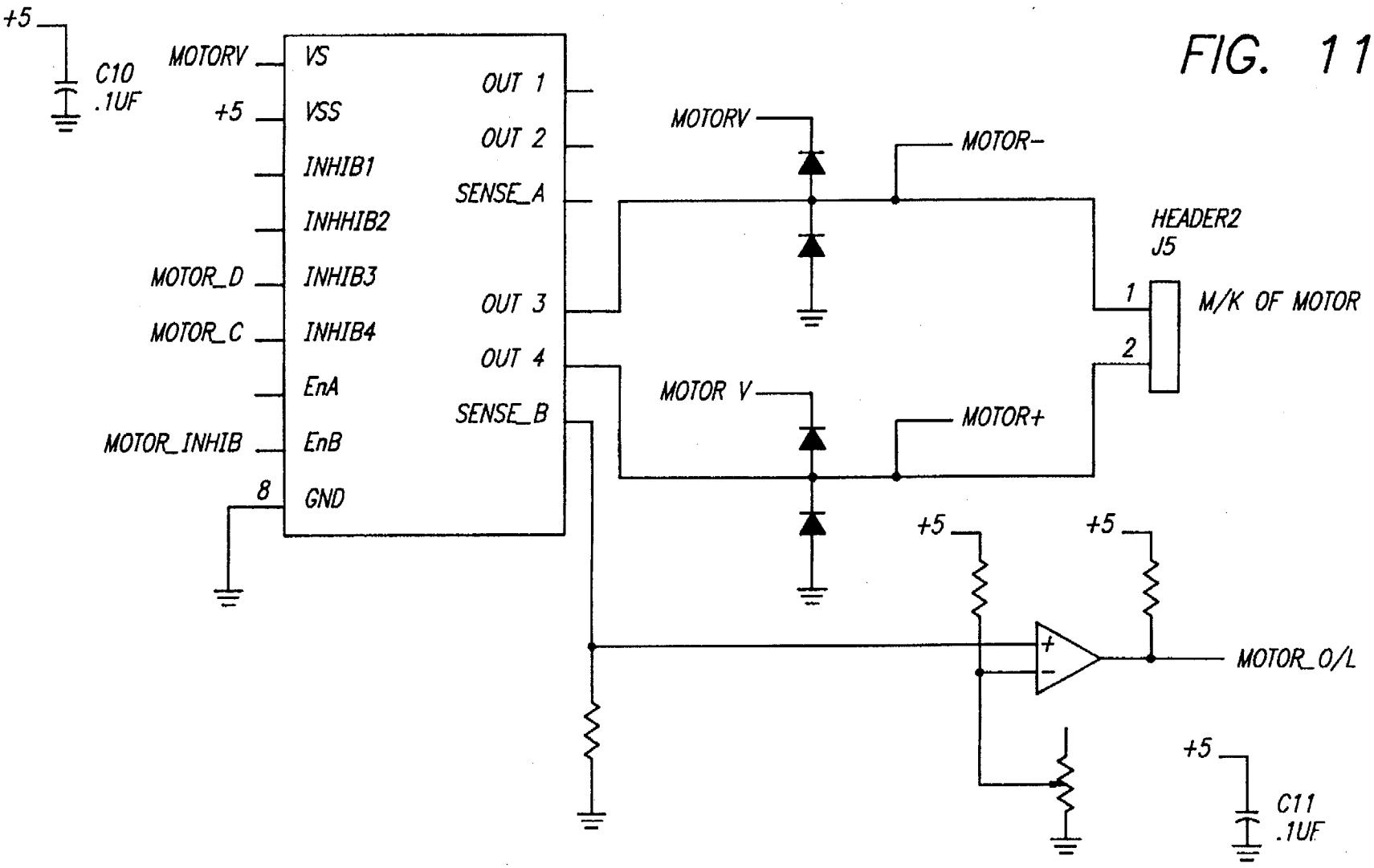
FIG. 11 is the motor controller circuit schematic diagram.

The motor controller circuit FIG. 11 is driven by a digital interface with the microprocessor circuit. The motor controller circuit provides power to the gear motor. A two conductor cables connects the gear motor to the electronic assembly circuit board. The motor controller circuit can provide four combinations of power to the gear motor. The motor controller can provide a positive voltage to the gear motor, which will cause the gear motor to turn in a clockwise direction, which causes the lead screw to rotate in a clockwise direction, which in turn causes the snatch vise carriage assembly to translate in a direction away from the racket cradle. The motor controller can also provide a negative voltage to the gear motor, which causes the motor to turn in a counter clockwise direction, which caused the lead screw to rotate in a counter clockwise direction which in turns causes the snatch vise carriage assembly to translate in a direction toward the racket cradle.

The motor controller can also provide a neutral voltage to the gear motor where a neutral voltage is defined as applying the same positive voltage to both leads of the gear motor. Applying a neutral voltage to the gear motor locks the motor in its current position, causing the gear motor to resists any torque placed on it by the lead screw via a longitudinal force exerted on the snatch vise carriage assemble, essentially locking the snatch vise carriage assembly in place.

The motor controller circuit can also place no voltage on the gear motor. No voltage corresponds to placing zero volts on both leads of the gear motor. Placing no voltage on the gear motor allows the gear motor to turn when a torque is applied to the drive shaft via the lead screw, when a longitudinal force is exerted on the snatch vise carriage assembly, thus allowing the snatch vise carriage assemble to translate when a longitudinal force is exerted on the snatch vise.

The electronic keypad consists of a switch matrix with eleven switches, five LEDs and a ribbon cable. The ribbon cable connects the electronic keypad to the electronic assembly circuit board. The electronic keypad switch matrix consists of four scan lines and four read lines, where a particular scan line is connected to a particular read line when a particular switch is closed. The four scan lines and four read lines are connected to the keypad circuit. The keypad circuit sequentially places a voltage on one and only one of the scan lines at a time, and then checks the four read line for said voltage. The keypad circuit sequences through all four scan lines, before repeating the cycle. If a particular switch is pressed, the keypad circuit passed the particular switch ID to the microprocessor circuit via a digital interface.

The LED drive circuit interfaces with the microprocessor circuit via a digital interface. The LED driver circuit is connected to the electronic keypad via the electronic keypad ribbon cable. The LED driver circuit can illuminate any combination of the electronic keypad LEDs. The LED driver circuit also consists of three seven segment numerical LEDs which can be made to display any three digit number.

The carriage position detection circuit consists of two mechanical lever arm position switches, with one switch known as the pull stop switch, and the other known as the push stop switch. The pull stop switch is located on the end of the electronic assembly circuit board, furthest away from the racket cradle, while the push stop switch is located on the opposite end of the circuit board. The pull stop switch will be activated by the snatch vise carriage assembly when the snatch vise carriage assembly translates to a point furthest away from the racket cradle. The push stop switch will be activated by the snatch vise carriage assembly when the snatch vise carriage assembly translate to a point nearest the racket cradle. The outputs of both the pull stop switch and the push stop switch are connected directly to the microprocessor circuit.

The microprocessor circuit consists of a microprocessor and support circuitry. The firmware, to run said microprocessor, resides within said microprocessor.

The microprocessor receives the following inputs; user keypad information via the keypad circuit, the bridge_strain value from the bridge strain gauge circuit, and the status of both the pull_stop and push_stop switch status via the snatch vise position detector circuit. The microprocessor has the following outputs; control of the gear motor via the motor controller circuit, control of both the singular LEDs and the seven segment numerical display.

Functional operation of the microprocessor circuit is controlled by the onboard firmware where said firmware performs all of the before mentioned functions of this electronic stringing device.

FIG. 7 shows the operational keypad. Power first applied to the present device initiates a self-test verifying the operation of the strain gauges, the motor drive screw assembly and the electronic controller assembly. The machine sets itself to zero, essentially calibrating itself. If the test is successful, the number 50.0 (pounds) or 22.7 (kilos) appears on the display representing a commonly used tension. The operator uses the up/down arrows to set his preferred tension if it is other than the default.

To store a new tension, he touches the M1 button momentarily and waits for a confirming beep and the lighting of an associated LED. Similarly he can store a second preference in M2. With two tensions stored in memory the operator has three tensions at his finger tips, M1, M2, and any other he sets as displayed on the display.

Prior to stringing, the operator has other controls to consider. He may choose to display the input tension in kilos rather than pounds. His choice will be acknowledged with a beep and a lighted LED.

The Speed control allows the rate at which the motor control assembly travels to be varied based on the operators preference after considering the capability of the string and the racket.

The Count control allows for the display of the number of 'pulls' or full cycle repetitions of the vise since the machine was turned on and is cumulative so long as power is on.

The Constant Pull control On/Off eliminates the enormous gap between mechanical and electronic machines. Constant Pull Off replicates the results of a traditional mechanical stringing machine wherein a brake is applied when the dialed-in tension is reached. There is no further movement of the vise even if the string looses elasticity and tension. With Constant Pull On, if the device senses a loss of tension of more than 0.5 pounds it re-applies the dialed-in tension.

Tension settings and other controls are made by the operator and displayed at the keypad. When the pulled string reaches the displayed tension, a beep sounds to indicate success. If the vise reaches its furthest extension yet has not tensioned the string as programmed, a series of beeps indicates the string reached the pull stop switch and has not reached the dialed-in tension.

What is claimed is:

1. A tension head assembly comprising:

a snatch vice for engaging a racket string; and a motor drive screw assembly operatively connected to said snatch vice such that the snatch vice is movable in a direction away from a racket thereby creating tension in a string.

2. The tension head assembly of claim 1 wherein the motor drive screw assembly comprises a lead screw and nut coupled to a reversible, electric motor.

3. The tension head assembly of claim 2 wherein the motor is controlled by a motor controller assembly which accepts input from a strain gauge.

4. The tension head assembly of claim 3 wherein the circuitry of said motor controller assembly is temperature compensated.

5. The tension head assembly of claim 3 wherein said motor controller assembly provides the operator the option either to halt the motor with pull and brake or to apply constant pull to the string.

6. The tension head assembly of claim 3 wherein the motor controller assembly accepts input from the operator to vary the speed of the motor.

7. The tension head assembly of claim 3 wherein the number of full cycle repetitions of applying and then releasing tension from the string are counted and displayed.

8. The tension head assembly of claim 3 wherein the tension is displayed.

9. The tension head assembly of claim 8 wherein the operator has the option to choose a tension reading in pounds or kilograms.

10. A racket stringing machine comprising:

a base;

a racket cradle assembly supported by the base;

a tension head bar extending outwardly from the base; and a tension head assembly supported by and connected to the tension head bar, said tension head assembly comprising:

a snatch vice for engaging a racket string; and a motor drive screw assembly operatively connected to said snatch vice such that the snatch vice is movable in a direction away from a racket thereby creating tension in a string.

11. The racket stringing machine of claim 10 wherein the motor drive screw assembly comprises a lead screw and nut coupled to a reversible, electric motor.

12. The racket stringing machine of claim 10 wherein the motor is controlled by a motor controller assembly which accepts input from a strain gauge.

13. The racket stringing machine of claim 12 wherein the circuitry of said motor controller assembly is temperature compensated.

14. The racket stringing machine of claim 12 wherein said motor controller assembly provides the operator the option either to halt the motor with pull and brake or to apply constant pull to the string.

15. The racket stringing machine of claim 12 wherein the motor controller assembly accepts input from the operator to vary the speed of the motor.

16. The racket stringing machine of claim 10 wherein the number of full cycle repetitions of applying and then releasing tension from the string are counted and displayed.

17. The racket stringing machine of claim 10 wherein the tension is displayed.

18. The racket stringing machine of claim 17 wherein the operator has the option to choose a tension reading in pounds or kilograms.

* * * * *